US006619995B1

(12) United States Patent
Hayashi et al.

(10) Patent No.: US 6,619,995 B1
(45) Date of Patent: Sep. 16, 2003

(54) ELECTRONIC DEVICE CONNECTOR AND CONNECTION STRUCTURE FOR USE WITHIN A VEHICULAR ENVIRONMENT

(75) Inventors: Hiroyuki Hayashi, Nagoya (JP); Shinichi Yamada, Yokkaichi (JP)

(73) Assignees: Autonetworks Technologies, Ltd., Aichi (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/712,299

(22) Filed: Nov. 15, 2000

(30) Foreign Application Priority Data

Nov. 19, 1999 (JP) ..... 11-329424

(51) Int. Cl.[7] ..... H01R 13/502
(52) U.S. Cl. ..... 439/701; 439/364
(58) Field of Search ..... 439/701, 717, 439/680, 364, 34

(56) References Cited

U.S. PATENT DOCUMENTS 3,447,036 A * 5/1969 Dore et al. ..... 439/701
5,057,971 A 10/1991 Hautvast et al.
5,271,689 A * 12/1993 Ishii et al. ..... 439/364
5,274,570 A 12/1993 Izumi et al.
5,336,109 A 8/1994 Hillbish et al.
5,431,573 A 7/1995 Endo et al.
5,529,426 A 6/1996 Masuda et al.
5,564,953 A 10/1996 Endo et al.
5,775,953 A * 7/1998 Yamanashi et al. ..... 439/701
6,007,386 A * 12/1999 Okabe ..... 439/701
6,179,653 B1 * 1/2001 Cheng et al. ..... 439/541.5

FOREIGN PATENT DOCUMENTS

FR 2 720 594 A1 12/1995

* cited by examiner

*Primary Examiner*—Renee Luebke
*Assistant Examiner*—Felix O. Figueroa
(74) *Attorney, Agent, or Firm*—Oliff & Berridge, PLC

(57) ABSTRACT

Device-side connectors 14A and 14*b* are provided on a plurality of electronic control units 10A and 10B, respectively. A harness-side connector 20 is provided at a wire harness 30. The harness-side connector 20 has a plurality of fitting convex portions 21 integrally formed in such a manner as to be connectable to the device-side connectors 14A and 14B. Each of the electronic control units 10A and 10B is accommodated in, for instance, a case 12, so that relative positions of the control units are fixed therein. Thus, the fitting convex portion 21 can be simultaneously coupled to the device-side connectors 14A and 14B.

2 Claims, 7 Drawing Sheets

ELECTRONIC DEVICE CONNECTOR AND CONNECTION STRUCTURE FOR USE WITHIN A VEHICULAR ENVIRONMENT

BACKGROUND OF THE INVENTION

1. Field of the Invention

The present invention relates to a connector for connecting an electric wire component, such as a wire harness, to an electronic device, such as an electronic control unit, and also relates to a connection structure using this connector.

2. Description of the Related Art

Generally, electrical connection between an electronic device mounted on a vehicle, such as an automobile, and an electronic wire component, such as a wire harness, is established through connectors that can be coupled to each other. FIG. 9 shows an example of a wiring arrangement using these connectors.

FIG. 9 illustrates an example of connection of an air bag control unit 70 A, which is an electronic device, to a power supply 40 and to a collision sensor 42 by using a wire harness 60. The wire harness 60 shown in this figure has three terminals at which the power supply 40, the collision sensor 42, and a connector 62A are provided, respectively. On the other hand, a connector 72A is provided on the air bag control unit 70A. This connector 72A is coupled to the connector 62A so that the air bag control unit 70A is connected to the power supply 40 and the collision sensor 42 through the wire harness 60.

In this circuit, electric power is supplied from the power supply 40 to the air bag control unit 70A. Further, a collision detection signal outputted from the collision sensor 42 is inputted to this air bag control unit 70A whereby a control signal is outputted from the air bag control unit 70A to an air bag device (not shown), so that the air bag device is activated.

Meanwhile, according to upgrading a vehicle and such like, there is sometimes the necessity for connecting a side air bag control unit 70B to the power supply 40 and the collision sensor 42 in such a circuit, in addition to the side air bag control unit 70. In such a case, conventionally, another wire serving as a branch line is branched from the wire harness 60, as indicated by a dashed line drawn in FIG. 9. A connector 62B other than the connector 62A is disposed at an end of the branch line and coupled to a connector 72B mounted on the side air bag control unit 70B.

The configuration illustrated in FIG. 9 has the following problems to be solved.

(1) When the side air bag control unit 70B is added to the circuit, the branch line branched from the wire harness 60 should be added. Moreover, the additional connector 62B other than the connector 62A should be provided at the end of this branch line. Therefore, a shape of the wire harness 60 is complicated. Moreover, the number of necessary connectors should be increased. Consequently, the number of components of an entire wiring system is increased. Furthermore, the branch line should be branched from a suitable position on a main line of the wire harness 60. Thus, it is not easy to manufacture the wire harness 60 itself.

(2) A plurality of connectors 62A and 62B should be connected to the control units 70A and 70B at different places, respectively. Such an operation is troublesome. Moreover, operations of managing connection of the each connector should be performed at a plurality of places, and are complicated.

SUMMARY OF THE INVENTION

In view of such circumstances, an object of the present invention is to eable efficient connection of a common electric wire component to a plurality of electronic devices by using a system of a simple configuration at little expense in time and effort.

To solve the aforementioned problems, the invention is an electronic device connecting connector for connecting a common electric wire component to a plurality of electronic devices, the electronic device connecting connector comprising a plurality of device-side connectors provided in the electronic devices, respectively and a wire-component-side connector provided at the electric wire component. This wire-component-side connector is integrated combination of a plurality of coupling portions able to couple to each of the device-side connectors.

Moreover, the invention is a structure for connecting a common electric wire component to each of the electronic devices by using this electronic device connecting connector. This structure comprises the device-side connectors, each of which is provided at each of the electronic devices, the wire-component-side connector provided at the electric wire component, and positioning member for fixing a relative position of each of the electronic devices so that a location of each of the coupling portions of this wire-component-side connector coincides with a location of the device-side connectors.

With the aforementioned configuration, the coupling portions of the wire-component-side connector can be simultaneously coupled to each of the device-side connectors by adjusting the relative position of each of the electronic devices provided with the device-side connector to a specific relative position (that is, a relative position where the location of each of the coupling portions of the wire-component-side connector coincides with the location of each of the device-side connectors) . This coupling enables the common connection between the electric wire component provided with the wire-component-side connector and each of the electronic devices. Thus, there is no necessity for increasing the number of wire-component-side connectors and branching the wire component into many branch lines. Moreover, the connection between the electric wire component and each of the electronic devices can be established by once performing a connector connecting operation. Furthermore, the management of all of such connections can be performed at a place.

Incidentally, when the number of components of this wire-component-side connector itself can be reduced by forming a plurality of coupling portions to be integrated with a housing of the wire-component-side connector, the configuration of the connector can be simplified.

Preferably, the positioning member for positioning the plurality of electronic devices has, for example, a case for holding the plurality of electronic devices at predetermined positions. The case is configured so that during the plurality of electronic devices are held at the predetermined positions in this case, the location of each of the coupling portions of this wire-component-side connector coincides with the location of each of the device-side connectors. With this configuration, each of the electronic devices can be stably held at an appropriate position (that is, a position where each of the device-side connectors can be coupled to each of the wire-component-side connector) . Thus, the appropriate placement of the electronic devices is achieved only by setting the electronic devices in the case.

Further, the positioning member may have positioning portions able to engage with the plurality of electronic devices. Moreover, each of the electronic devices maybe fixed at a relative position, at which the location of each of the device-side connectors coincides with the location of the coupling portions of the wire-component-side connector, by engaging the positioning portions with one another.

In this case, a recess portion serving as the positioning portion is provided in one of two electronic devices. Further, a convex portion serving as the positioning portion to be fitted into the recess portion is provided in the other of the two electronic devices. Moreover, a bolt insertion hole is provided in the wire-component-side connector. A screw hole is provided in this bolt insertion hole. The bolt inserted into this bolt insertion hole is screwed into the screw hole to thereby tighten the wire-component-side connector and the device-side connector provided on each of the electronic devices together securely. Thus, the positioning convex portion is effectively utilized, so that a space, in which the screw hole is provided, can be ensured in the electronic devices. Furthermore, a sufficient fitting force for connecting the device-side connectors to the wire-component-side connector can be ensured by screwing the bolt into this screw hole.

Furthermore, the structure may be configured so that while the convex portion is fitted into the recess portion, the device-side connectors of both the electronic devices are disposed at positions, between which the screw hole is provided, and that the bolt insertion hole is provided between both the coupling portions of the wire-component-side connector. Thus, a bolt tightening force can be uniformly exerted on both device-side connectors (or both the coupling portions thereof) to thereby realize well-balanced coupling. Consequently, an occurrence of twisting of the connectors can be more reliably prevented.

DETAILED DESCRIPTION OF THE PREFERRED EMBODIMENTS

Figure 1:
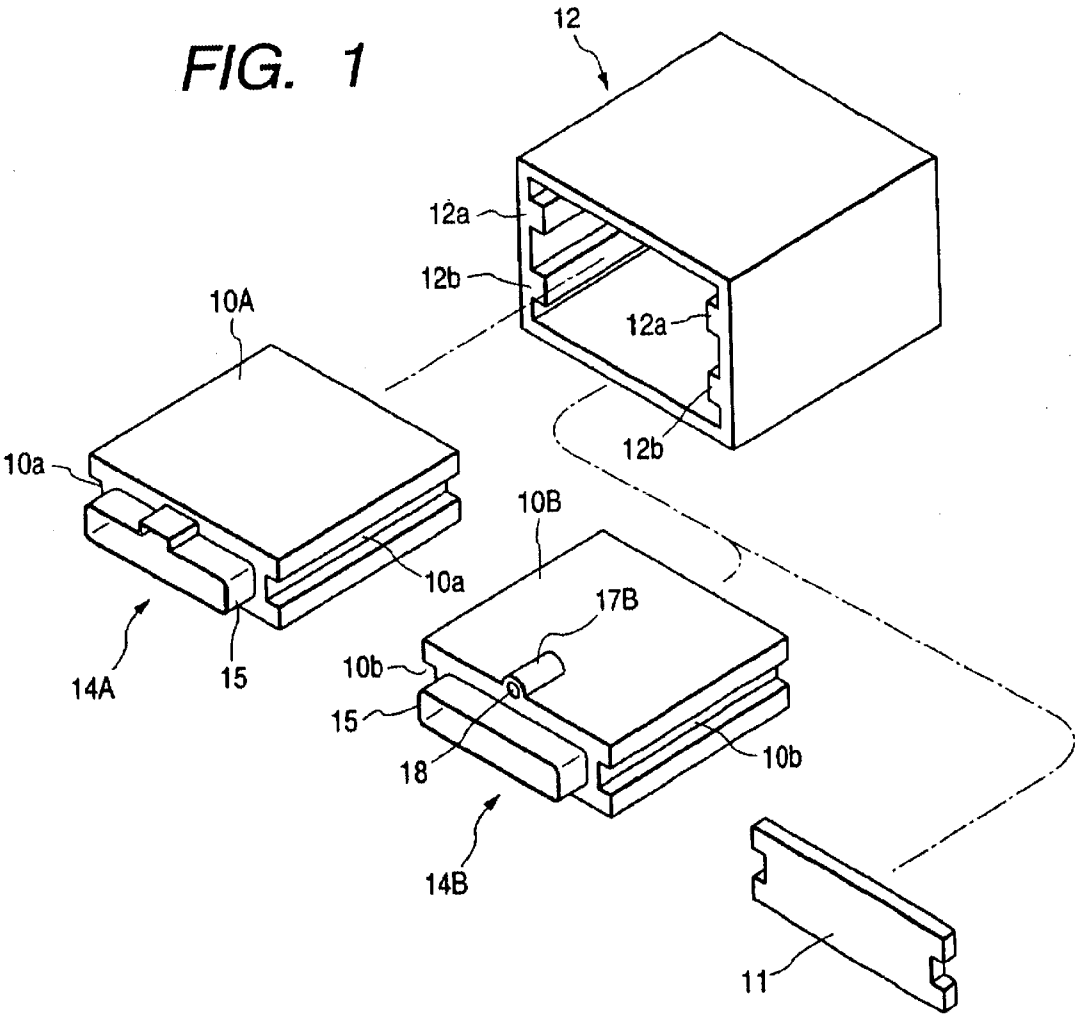
FIG. 1 is an exploded perspective view of a structure according to an embodiment of the invention, connecting a wire harness to an electronic control unit.

Preferred embodiments of the present invention will be described hereinbelow with reference to the accompanying drawings.

A structure described hereinbelow is used for connecting a common wire harness 30 shown in FIG. 2 and such like to two electronic control units (electronic devices) 10A, 10B shown in FIG. 1 and such like. This structure has a single case 12 and configured so that both the two electronic control units 10A and 10B are accommodated and held in this case 12.

Each of the electronic control units 10A and 10B has a substrate case for storing a control substrate. An outside shape of the case is a nearly rectangular flat box, as illustrated in the figure. Concave grooves 10*a* extending in a frontward and rearward directions are formed in both lateral side surfaces of the electronic control unit 10A, respectively. A device-side connector 14A connected to the internal control substrate is fixed on a front surface of the control unit 10A. Similarly, concave grooves 10*b* extending in a frontward and rearward directions are formed in both lateral side surfaces of the electronic control unit 10B, respectively. A device-side connector 14B connected to the internal control substrate is fixed on a front surface of the control unit 10B.

On the other hand, the case 12 is shaped in such a way as to be opened to a front thereof. In the lateral inner side surfaces of the case 12, two ridges, namely, upper and lower ridges 12*a* and 12*b* are formed. Further, the electronic control units 10A and 10B are inserted and slid from the front into upper and lower portions of the case 12, respectively, so that these ridges 12*a* and 12*b* are fitted into the concave grooves 10*a* and 10*b*, respectively. Thus, both the electronic control units 10A and 10B are held at the upper and lower positions in the case 12, respectively. Moreover, the device-side connectors 14A and 14B provided on the electronic control units 10A and 10B, respectively, are arranged in upward and downward directions.

Further, a recess portion 17A is formed in a central part of a bottom portion of the case for the upper electronic control unit 10A. A convex portion 17B, which can be fitted into the recess portion 17A, is formed in a central part of a top portion of the case for the lower electronic control unit 10B. Even when the convex portion 17B is fitted into the recess portion 17A, a relative position in a direction of width of each of the electronic control units 10A and 10B is fixed. Further, in the convex portion 17B, a screw hole 18 opened to the front is formed.

A hood 15 opened to the front is formed on each of the housing of the device-side connectors 14A and 14B. Many male terminals 16 are provided on an inside of this hood 15.

On the other hand, a harness-side connector (a wire-component-side connector) 20, which can be coupled to both the device-side connectors 14A and 14B, is provided at a terminal of the wire harness 30. A pair of upper and lower fitting convex portions (coupling portions) 21 are formed to be integral with the housing of the harness-side connector 20. Each of the fitting convex portions 21 is formed to be able to be fitted into each of the hoods 15 provided on the device-side connectors 14A and 14B. In other words, the fitting convex portion 21, which can be fitted into each of the hoods 15, is integrally formed therewith as a single connector housing. Moreover, a location of the fitting convex portions 21 coincide with that of the device-side connectors 14A and 14B in a state in which both the electronic control units 10A and 10B are held in the case 12, respectively.

Figure 4:
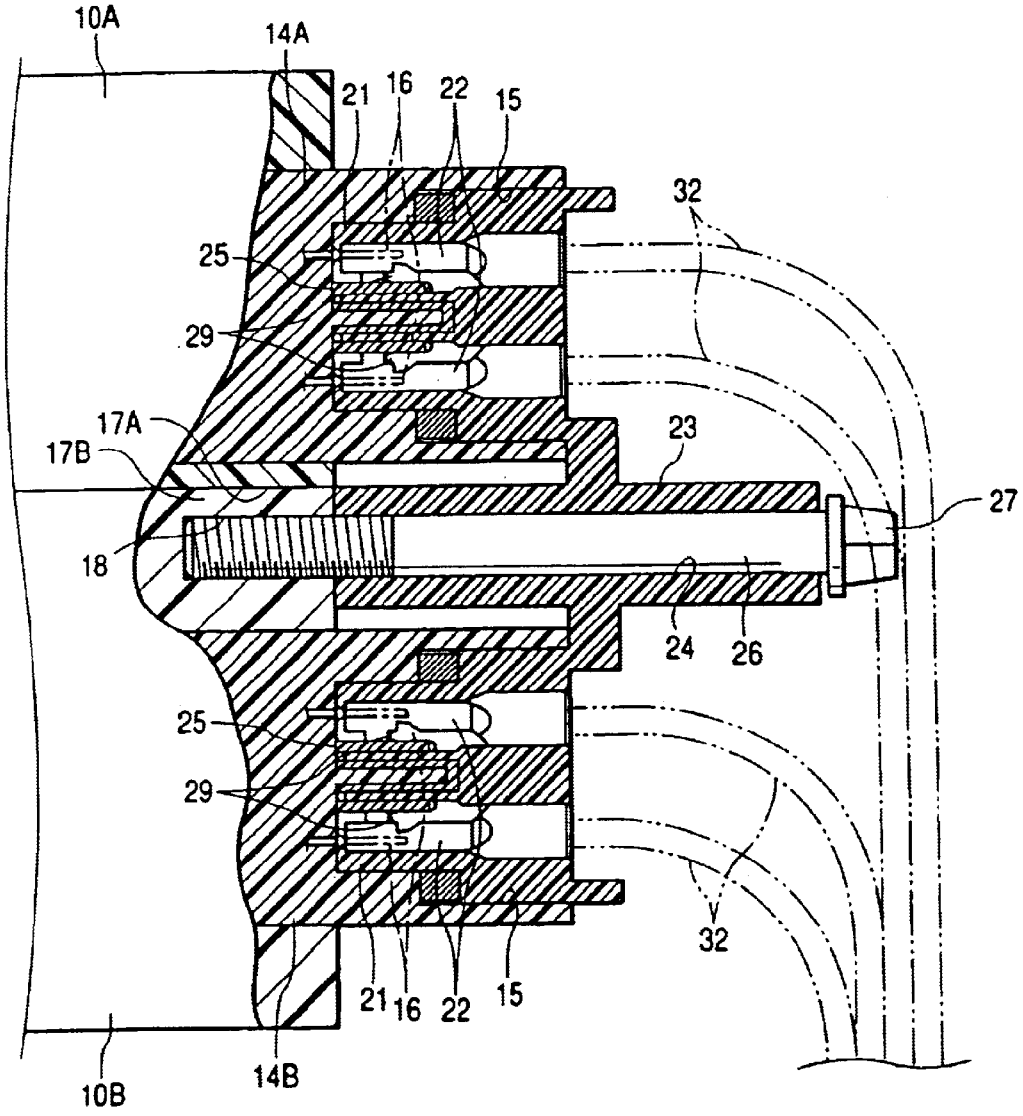
FIG. 4 is a partially sectional side view of the connection structure.

A terminal accommodating chamber is formed in each of the fitting convex portions 21. Female terminals 22 shown in FIG. 4 are fixed in the each terminal accommodating chambers. These female terminals 22 are fixed at terminals of the electric wires 32 included in the wire harness 30. Moreover, male terminals 16 of the device-side connectors 10A and 10B are fitted into these female terminals 22. In each of the terminal accommodating chambers of the fitting convex portions 21, flexible lances 29 shown in FIG. 4 are formed. Further, retainers 25 shown in this figure is attached to each of these fitting convex portions 21 from the front side (namely, the left-hand side in FIG. 4). Thus, the lances 29 are cramped and take such a shape to catch the female terminals 22, respectively.

A bolt insertion cylinder portion 23 shaped to pass through the harness-side connector 20 in an axial direction is formed at a central position (namely, the position between both the fitting convex portions 21) of the harness-side connector 20. This bolt insertion cylinder portion 23 constitutes a bolt insertion hole 24, through which a bolt 26 can pass through. The bolt 26 comprises a head portion 27 having a modified cross-section and being able to be rotated by using a tool. A tip end portion at an opposite side of the bolt 26 can be screwed into the screw hole 18 of the electronic control unit 10B.

With this configuration, the common wire harness 30 is easily connected to both the electronic control units 10A and 10B according to, for example, the following procedure.

1)The electronic control unit 10A is slid and inserted into the upper step of the case 12 while fitting the concave grooves 10*a* of the electronic control unit 10A into the ridges 12*a* of the case 12, respectively. Subsequently, the electronic control unit 10B is slid and inserted into the lower step of the case 12 while fitting the concave grooves 10*b* of the electronic control unit 10B and the recess portion 17A into the ridges 12*b* of the case 12 and the convex portion 17B of electronic control unit 10B, respectively. Thus, the screw hole 18 is placed between both the device-side connectors 14A and 14*b* (shown in FIG. 3).

Incidentally, the inserting order of these electronic control units 10A and 10B may be reversed. Further, both the electronic control units 10A and 10B may be simultaneously inserted into the case 12 by preliminarily fitting the convex portion 17B into the recess portion 17A.

2) The fitting convex portions 21 of the harness-side connector 20 are provisionally fitted into the hoods 15 of the device-side connectors 14A and 14B, respectively.

3) The bolt 26 is inserted into the bolt insertion hole 24 of the bolt insertion cylinder portion 23. Moreover, this bolt 26 is rotated thereby to be screwed and inserted into the screw hole 18 of the electronic control unit 10B. That is, the bolt 26 is screwed into the screw hole 18 of the electronic control unit 10B while passing through the harness-side connector 20.

As this bolt 26 is fastened, the male terminals 16 of the first-device-side connectors 14A and 14B are gradually fitted into the female terminals 22 of the harness-side connector 20. Finally, the first-device-side connectors 14A and 14B and the harness-side connector 20 are securely tightened together.

That is, with this configuration, after completion of insertion of both the electronic control units 10A and 10*b* into the case 12, both the device-side connectors 14A and 14B are coupled together to the single harness-side connector 20, whereby the common wire harness 30 can be simultaneously connected to the two electronic control units 10A and 10B. Consequently, the wire harness 30 can be simultaneously connected to the two electronic control units 10A and 10B with efficiency by performing a connector coupling operation only once without increasing the number of necessary connectors and branching the wire harness 30 into many branch lines.

Figure 2:
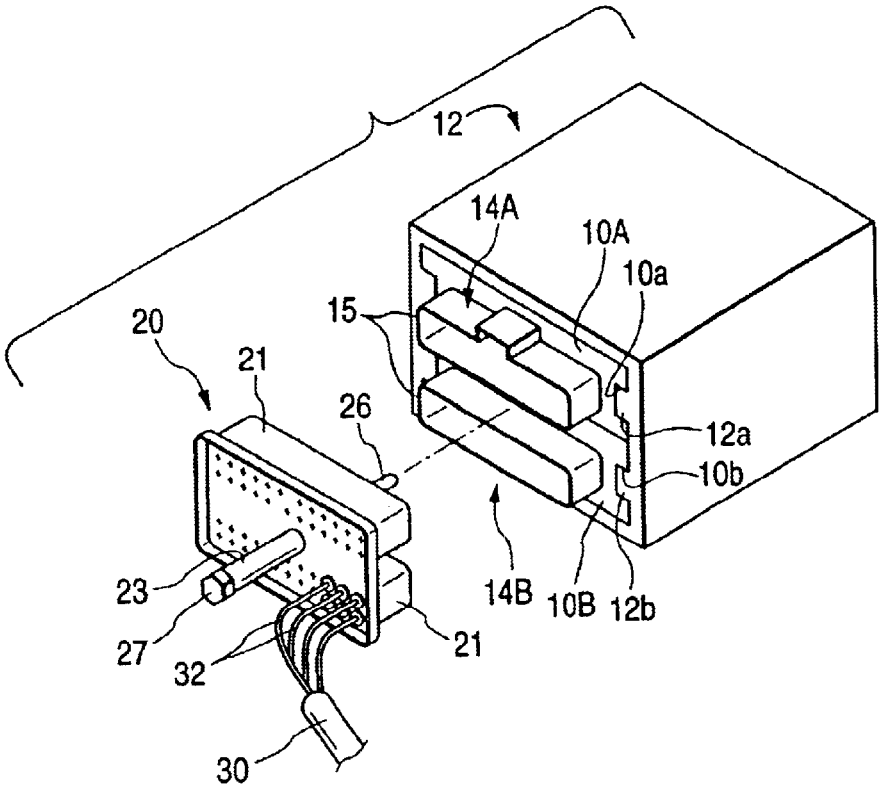
FIG. 2 is a perspective view of a state in which the electronic control units are held in a common case.
Figure 5:
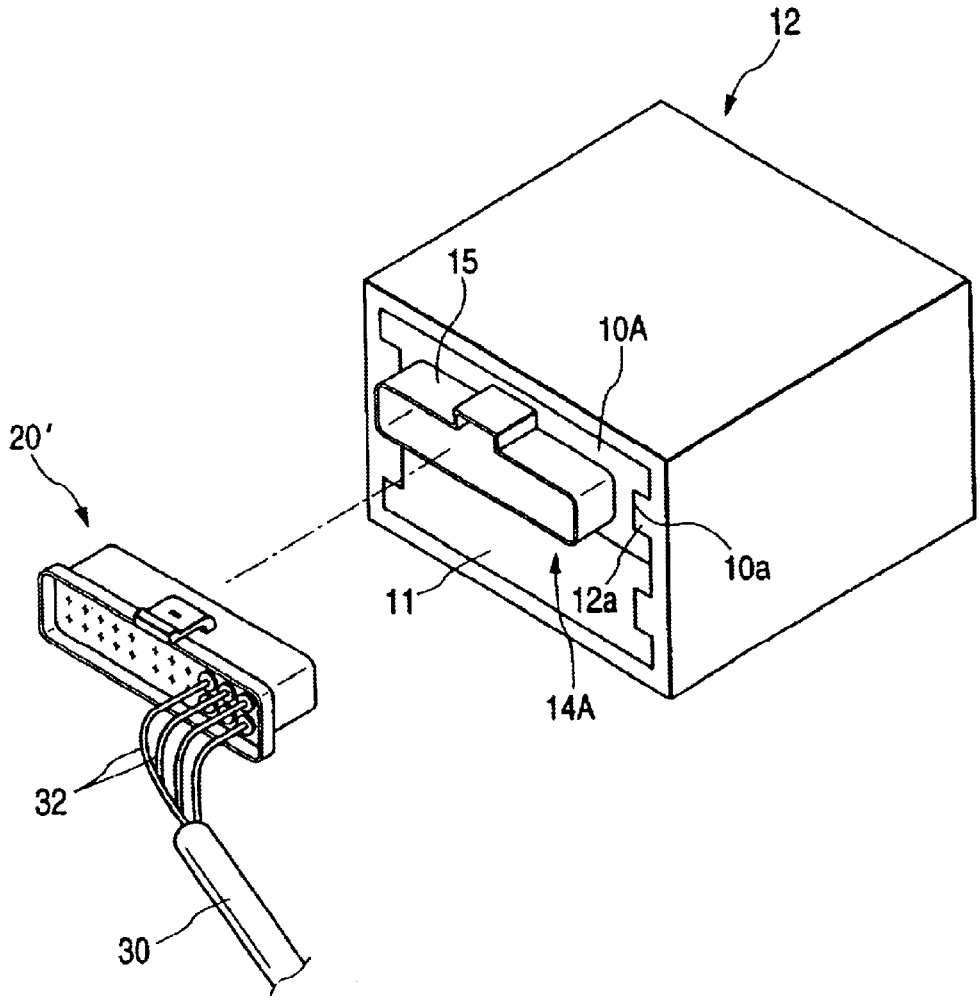
FIG. 5 is a perspective view of an example implemented by omitting one of the electronic control units of the connection structure.

Further, in the case of connecting the wire harness 30 only to the electronic control unit 10A, as illustrated in FIG. 5, a lower opening of the case 12 is blocked by using, for instance, a dummy plate 11 shown in FIG. 1. Instead of the harness-side connector 20, a harness-side connector 20', which can be coupled only to the device-side connector 14A and has an ordinary constitution (see FIG. 5), is provided at the terminal of the wire harness 30. Consequently, the structure according to this embodiment can easily deal with this situation. Therefore, an alteration of vehicle-mounted devices, which is associated with the upgrading of the vehicle, is easily dealt with, and the general versatility is enhanced.

Figure 3:
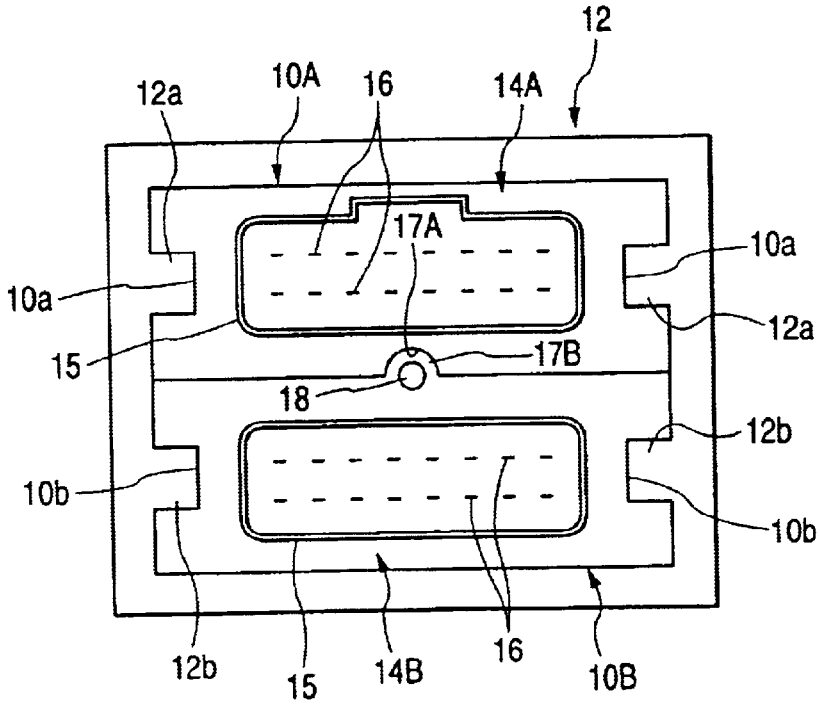
FIG. 3 is a front view of the state illustrated in FIG. 2.
Figure 6A:
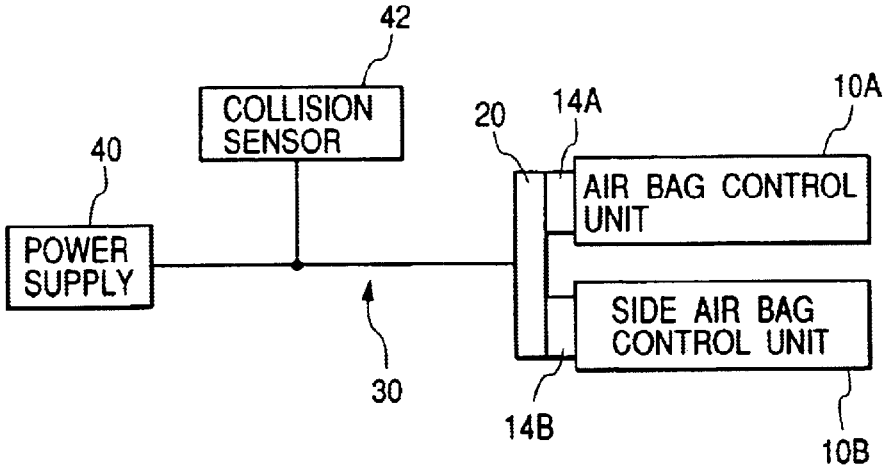
FIGS. 6A and 6B are block views of examples of a circuit to which the connection structure is applied.

FIG. 6 illustrates practical examples of the above described. In the case of the example shown in FIG. 6A, an air bag control unit corresponds to the electronic control unit 10A, and a side air bag control unit corresponds to the electronic control unit 10B. These control units are connected to a power supply 40 and a collision sensor 42 through the wire harness 30. In the case where the circuit of this example is configured according to ordinary specifications, it is sufficient that only the air bag control unit serving as the electronic control unit 10A is attached to the case 12 and that the wire harness 30 is connected only to the device-side connector 14A as shown in FIG. 5. Further, in the case where the circuit of this example is configured according to high-grade specifications, it is sufficient that the side air bag control unit serving as the electronic control unit 10B is attached to the case 12 in addition to the air bag control unit, as shown in FIGS. 2 to 4, and that the wire harness 20 is simultaneously coupled to both the device-side connectors 14A and 14B of the electronic control units 10A and 10B.

Figure 6B:
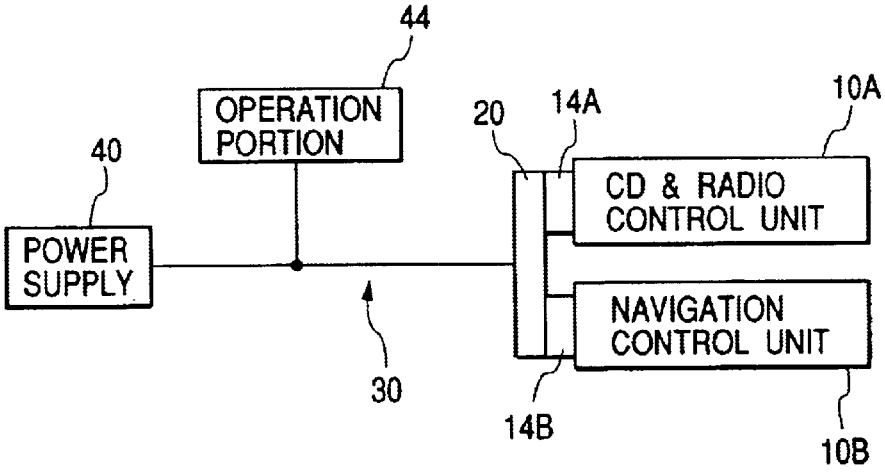

In the case of the example shown in FIG. 6B, the CD-and-radio control unit corresponds to the electronic control unit 10A and the navigation device control unit corresponds to the electronic control unit 10B. These control units are connected to the power supply 40 and the operating portion 44, such as a center cluster module, through the wire harness 30. In the case where the circuit of this example is configured according to ordinary specifications, it is sufficient that only the CD-and-radio control unit serving as the electronic control unit 10A is attached to the case 12 as shown in FIG. 5, and that the wire harness 30 is connected only to the device-side connector 14A. Further, in the case where the circuit of this example is configured according to high-grade specifications, it is sufficient that the navigation device control unit serving as the electronic control unit 10B is attached to the case 12 in addition to the CD-and-radio control unit, as shown in FIGS. 2 to 4, and that the wire harness 20 is simultaneously coupled to both the device-side connectors 14A and 14B of the electronic control units 10A and 10B.

In the case of any example, when the electronic control unit 10B is added to the circuit, there is no need for branching the wire harness 30 into branch lines. Moreover, the wire harness 30 can be connected to both the units 10A and 10B by maintaining the simple configuration of the circuit. Furthermore, the centralized management of all of such connections at a single place can be realized. Additionally, the maintenance of the circuit is easily achieved.

Figure 7:
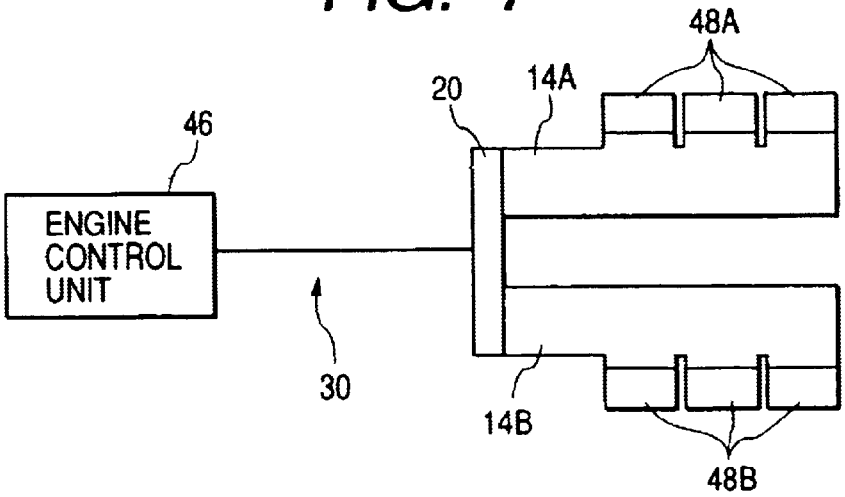
FIG. 7 is a schematic view of another example of application of the connection structure.

Incidentally, according to the present invention, an object connected to the electric wire component is not limited to the electronic control unit. The present invention has wide applicability to the case that the common wire component is connected to a plurality of electronic devices. For example, each of the device-side connectors 14A and 14B may be a distributing connector shown in FIG. 7.

The device-side connectors 14A and 14B illustrated in the figures are incorporated into, for instance, a cylinder head of an engine. A plurality of electromagnetic control valves (namely, valves for controlling intake and exhaust valves for a left cylinder of the engine) 48A disposed on the left-hand side of the engine are connected to one 14A of the device-side connectors. Further, a plurality of electromagnetic control valves (namely, valves for controlling intake and exhaust valves for a right cylinder of the engine) 48B disposed on the right-hand side of the engine are connected to the other 14B of the device-side connectors.

In the case where both the connectors 14A and 14B and the electromagnetic control valves 48A and 48B are placed in this structure so that both the device-side connectors 14A and 14B are disposed close to each other, and that the common harness-side connector 20 can be simultaneously coupled to both the connectors 14A and 14B, for example, an engine control unit 46 can be connected to both the device-side connectors 14A and 14B through this harness-side connector 20 and the wire harness 30. Moreover, a control signal can be transmitted from the engine control unit 46 to the electromagnetic control valves 48A and 48B through the device-side connectors 14A and 14B.

Additionally, there are, for instance, the following embodiments of the present invention.

Figure 8A:
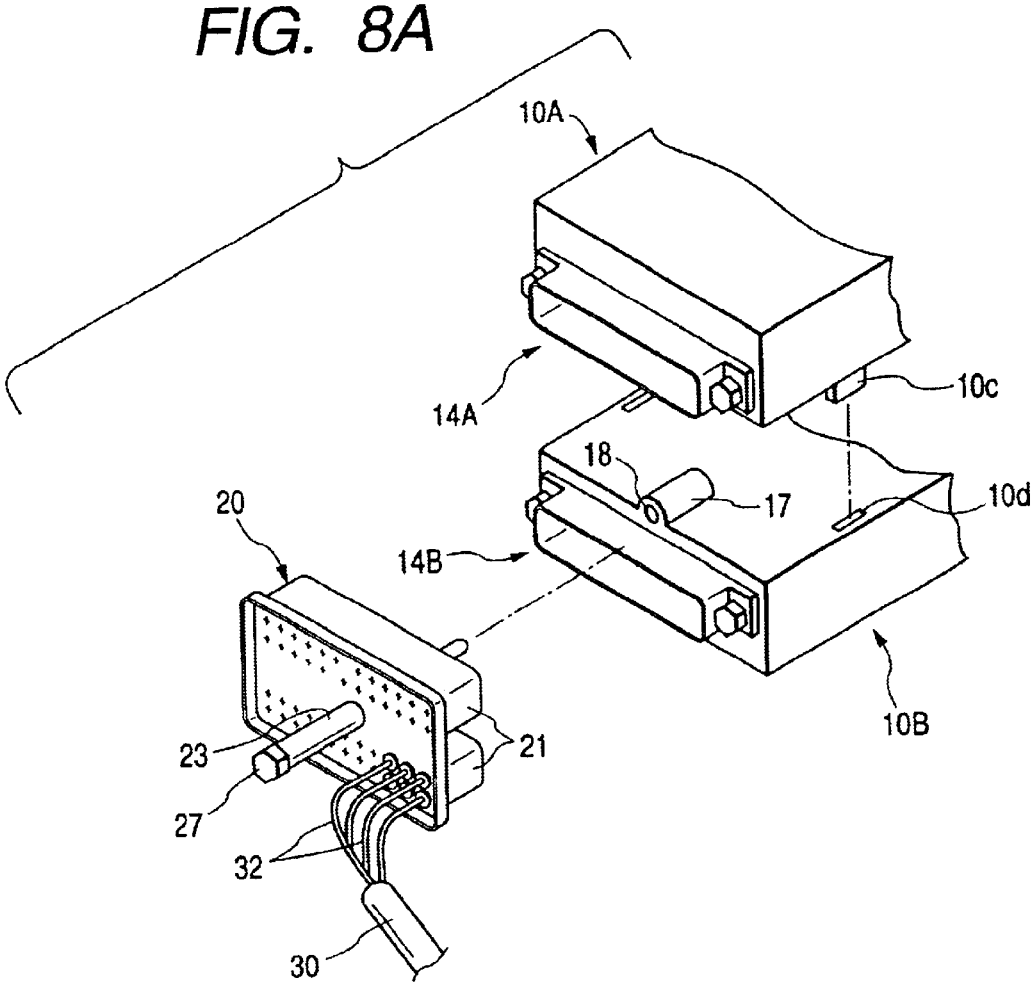
FIGS. 8A and 8B are perspective views of examples of modification of the connection structures.
Figure 8B:
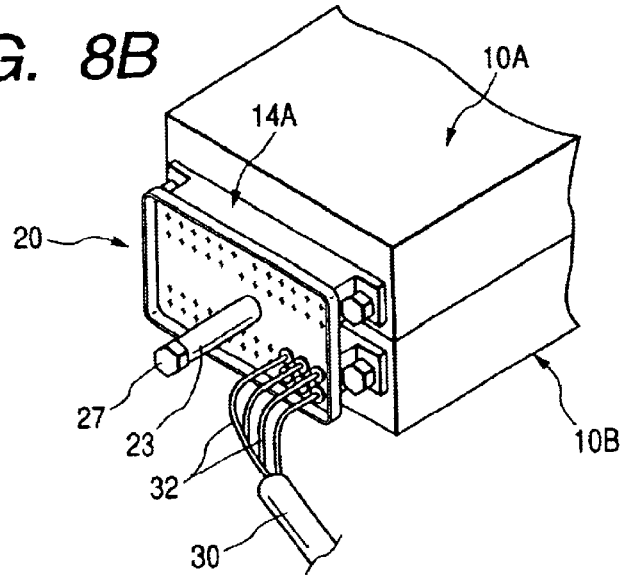
Figure 9:
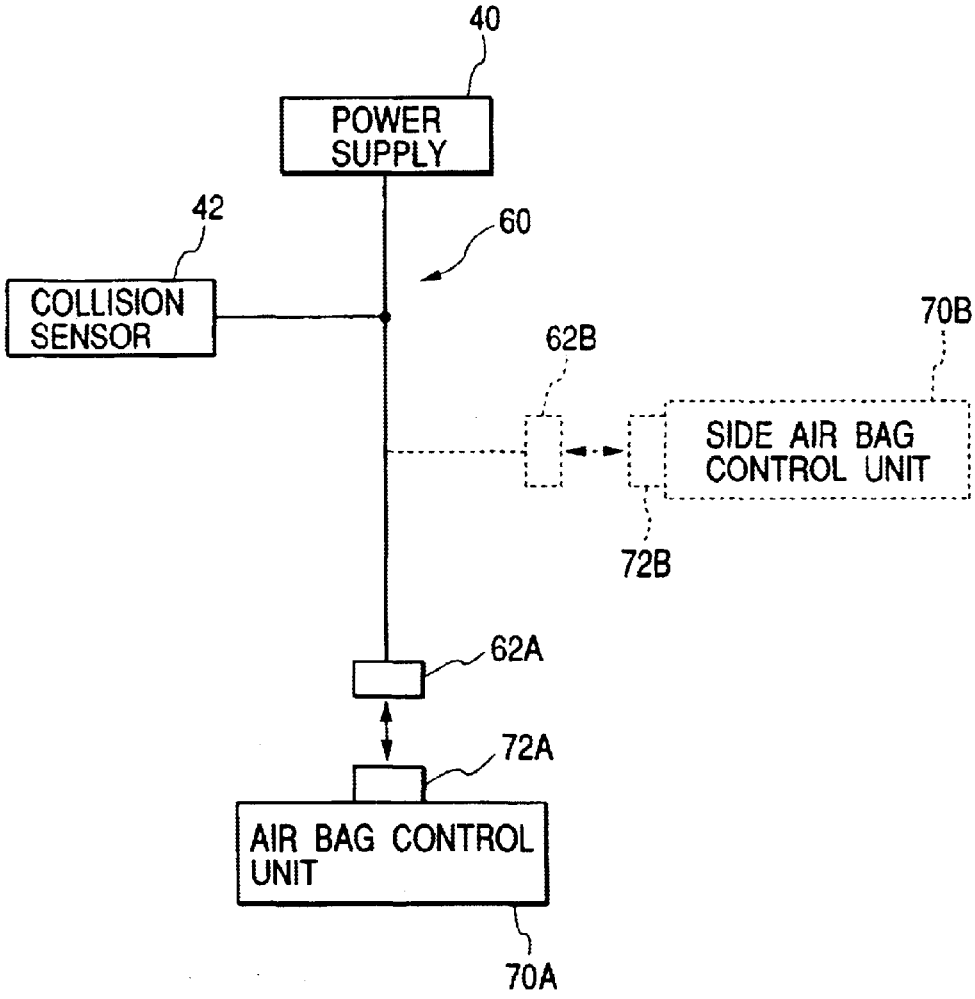
FIG. 9 is a block view of an example of a conventional wiring arrangement applied to electric devices.

Instead of using the case 12, an engaging portion (corresponding to the positioning portion) for fixing the relative position of each electronic device may be provided therein. For instance, as illustrated in FIGS. 8A and 8B, an engaging projection 10*c* is provided in one 10A of the electronic control units. An engaging recess portion 10*d* is provided in the other electronic control unit 10B. Both the electronic control units 10A and 10B may be adapted to be positioned at the normal relative positions, respectively, by engaging the engaging projection 10*c* with the engaging recess portion 10*d* (namely, the locations of the fitting convex portions 21 of the harness-side connector 20 coincide with the location of a corresponding one of the device-side connectors 14A and 14B, respectively).

According to the present invention, the "electric wire component" is not limited to the wire harness 30. The "electric wire component" may be a single cable that includes a plurality of wires.

In the foregoing description, there has been described the embodiment in which a plurality of fitting convex portions 21 are formed in the housing of the harness-side connector in such a manner as to be integral therewith. However, all the connectors may be integrally formed by cramping a plurality of coupling portions thereof by means of a holder (that is, the housing may be constituted by the plurality of coupling portions and the holder).

When the magnitude of the necessary fitting force of the connector is relatively small, the bolt 27 can be omitted. Even when this bolt 27 is used, the tightening position thereof can be suitably set. Incidentally, in the case that the convex portion 17B for positioning the device is provided in one of the electronic devices (namely, the electronic control unit 10B in the situation illustrated in FIG. 1), as described above, the screw hole 18 for screwing the bolt is provided in the convex portion 17B. Thus, a sufficient space for forming the screw hole 18 can be secured by effectively utilizing the convex portion 17B without increasing the size of the electronic device. Further, this screw hole 18 and the bolt insertion hole 24 of the harness-side connector 20 are provided at places between both the connectors 14A and 14B (namely, between the fitting convex portions 21). Thus, a bolt tightening force can be uniformly exerted on both device-side connectors, so that the well-balanced coupling is realized.

According to the present invention, the actual number and arrangement of the electronic devices and the device-side connectors are not limited. For instance, three or more electronic devices and device-side connectors may be arranged in upward and downward directions or in lateral directions. Alternatively, four or more electronic devices and device-side connectors can be arranged in longitudinal and transversal directions.

In the foregoing description, there has been the embodiment in which the device-side connectors 14A and 14B are male connectors having male terminals 16 and in which the harness-side connector 20 is a female connector having the female terminal 22. However, the device-side connectors may be such female ones, while the harness-side connector may be such a male connector. In this case, for example, a plurality of hoods are formed in the harness-side connector 20 in such a way as to be integral therewith. Further, the housing of each of the device-side connectors is fitted into a corresponding one of the hoods.

As described above, according to the present invention, the wire-component-side connector provided at the terminal of the wire component is simultaneously coupled to the plurality of device-side connectors provided on the plurality of electronic devices, respectively. Thus, the present invention has advantages in that the number of necessary connectors is prevented from increasing, and that the common connection of the electric wire component to the electronic components can be efficiently achieved at little expense in time and effort by employing a simple configuration in which the number of branch lines branched from the wire harness is limited.

What is claimed is:

1. A combination comprising:

a plurality of vehicular control units, and a structure that connects a common electric wire component to the plurality of vehicular control units, the structure comprising:

a plurality of device-side connectors provided respectively at the plurality of vehicular control units, each device-side connector including a plurality of terminals; and a wire-component-side connector provided at the electric wire component, the wire-component-side connector provided in such a manner that a plurality of coupling portions that couple respectively to the device-side connectors are integrally combined, each coupling portion including a plurality of terminals that connect respectively with the terminals in the corresponding device-side connector;

wherein the plurality of vehicular control units have a plurality of positioning portions, respectively;

the plurality of positioning portions are engagable with each other;

each of the vehicular control units is fixed at the relative position where the location of each of the device-side connectors coincides with the location of each of the coupling portions of the wire-component-side connector, by engaging the positioning portions with each other; the device-side connectors are two in number;

one of the two vehicular control units has a recess portion serving as the positioning portion;

the other of the two vehicular control units has a convex portion serving as the positioning portion and defining a screw hole;

the coupling portions of the wire-component-side connector are two in number;

the wire-component-side connector defines a bolt insertion hole; and a bolt inserted into the bolt insertion hole is screwed into the screw hole to thereby tighten the wire-component-side connector and the device-side connector of the vehicular control units.

2. The combination according to claim 1;

wherein the screw hole is provided to be positioned between the two vehicular control units while the convex portion is fitted into the recess portion; and the bolt insertion hole is provided between the two coupling portions of the wire-component-side connector.

* * * * *